United States Patent [19]

Snyder et al.

[11] Patent Number: 4,530,228

[45] Date of Patent: Jul. 23, 1985

[54] APPARATUS FOR PRODUCING SEAMLESS CONTAINER BODIES

[75] Inventors: Walter W Snyder, Burleson, Tex.; Dennis G. Dettmer, Naperville, Ill.

[73] Assignee: National Can Corporation, Chicago, Ill.

[21] Appl. No.: 477,372

[22] Filed: Mar. 21, 1983

[51] Int. Cl.[3] ..... B21D 22/28

[52] U.S. Cl. ..... 72/349; 72/347

[58] Field of Search ..... 72/347, 348, 349

[56] References Cited

U.S. PATENT DOCUMENTS 4,173,138 11/1979 Main ..... 72/349

4,173,882 11/1979 Lee ..... 72/349

*Primary Examiner*—Leon Gilden

*Attorney, Agent, or Firm*—Robert A. Stenzel; James W. Ove, Jr.

[57] ABSTRACT

An apparatus and method for the high speed production of seamless metal container bodies is disclosed utilizing a reciprocating ram which forces a relatively shallow metal cup through a die assembly to iron the sidewall of said cup to form an elongated ironed container body, the ram is supported and critically aligned by at least two stationary points and also at its rearward end by a slideable ram block assembly to which the ram is rigidly secured, the critical alignment of the rear end of the ram prevents misalignment of the ram relative to the die assembly to avoid producing container bodies of overly inconsistent length.

8 Claims, 10 Drawing Figures

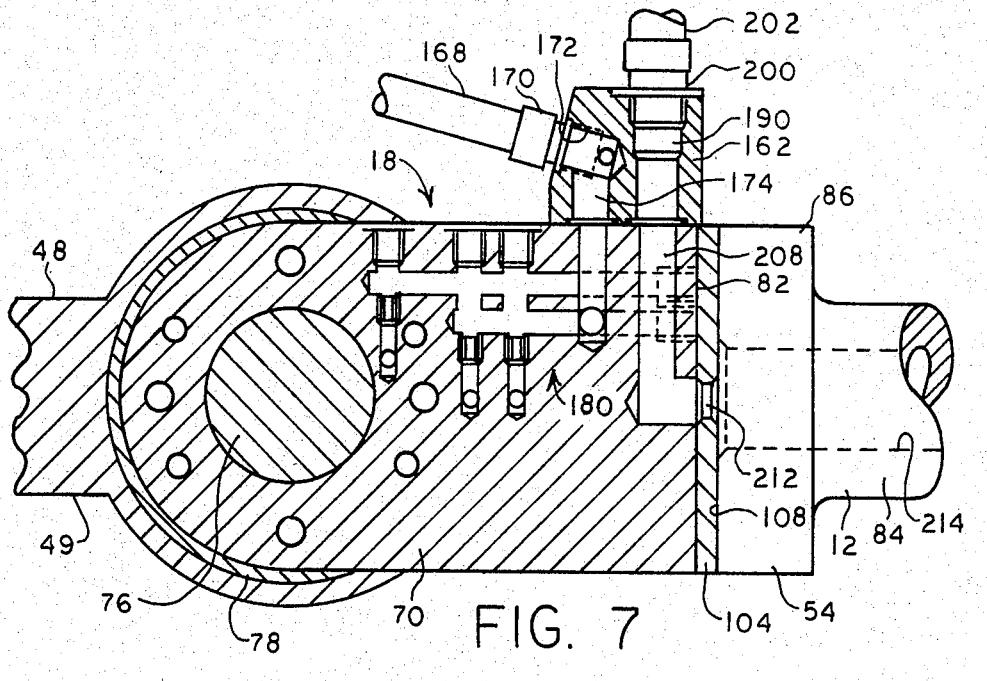
FIG. 7
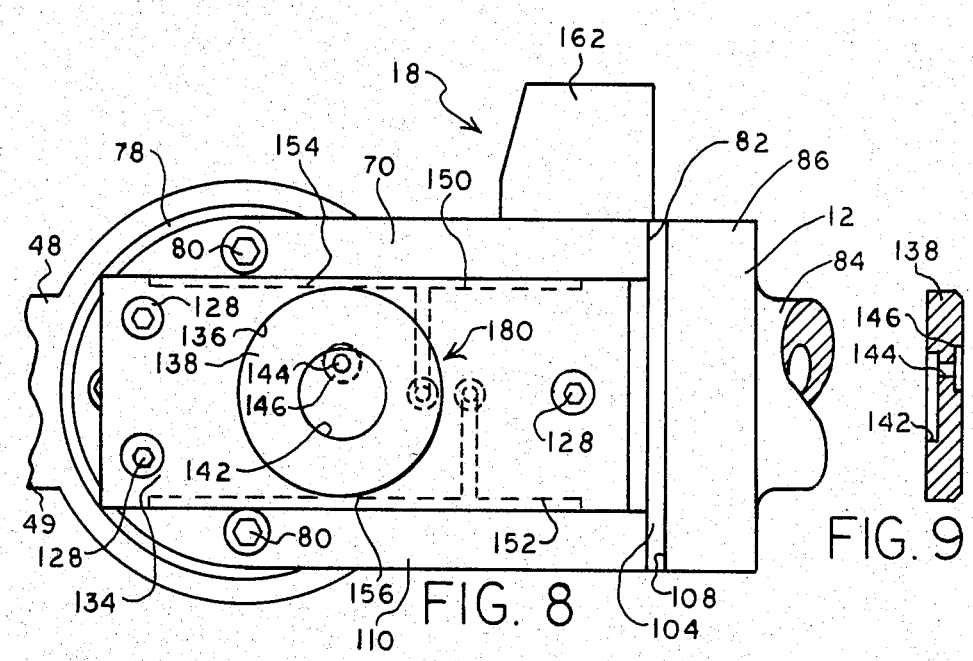
FIG. 8
FIG. 9

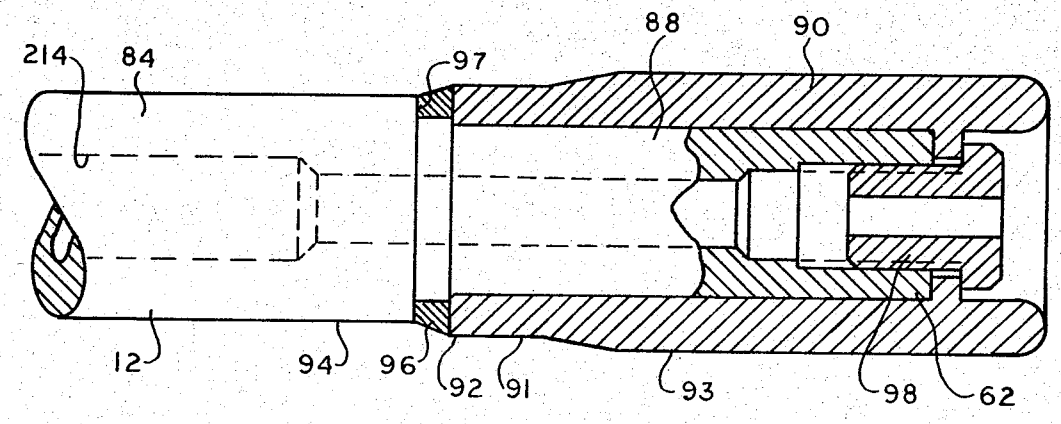
FIG. 10
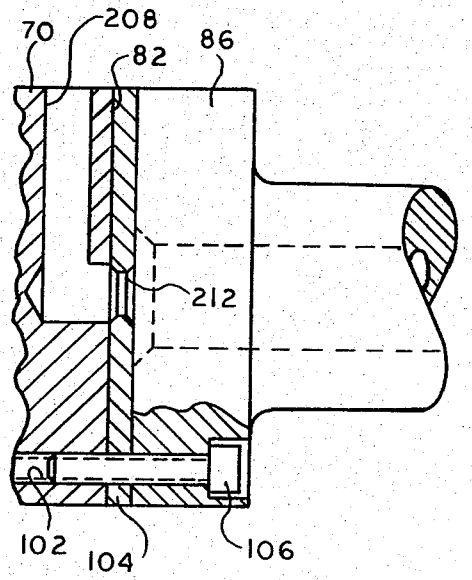

APPARATUS FOR PRODUCING SEAMLESS CONTAINER BODIES

TECHNICAL FIELD

The present invention relates to a method and apparatus for the production of drawn and ironed container bodies for two piece metal containers having a seamless body consisting of side wall and an integral bottom wall and an opposite end opening which is adapted to allow the application of an end closure such as by seaming the end closure to the top opening of the container body to produce a finished container. More specifically the present invention is directed towards an improvement of the container body forming apparatus for providing and maintaining more accurate alignment of the ram during the high speed formation of container bodies thereon, to produce ironed container bodies of more consistent length to allow the use of less metal stock to form the container bodies.

BACKGROUND OF THE PRIOR ART

Various processes are presently being utilized for forming seamless containers from flat metal blanks. One well known common commercial procedure involves first forming a circular metal blank from an aluminum, steel or other metal stock sheet. Subsequently, in what is commonly referred to as a cup maker machine the metal blank is formed into a shallow cup by forcing the blank through a drawing die by means of a punch mounted on a press. Such cups are then fed into a body maker apparatus wherein a recipprocating ram with a punch attached to the forward end thereof engages one of the cups and forces such cup through a die assembly having one or more dies to form an elongated seamless container body. The body maker dies may first include a redraw die which reforms the cup into a cup of smaller diameter and longer sidewalls and then a series of ironing dies having inside diameters which are progressly slightly smaller than the outside diameter of the cup. These ironing dies elongate the sidewall of the redrawn cup by reducing its thickness without reducing the inside diameter of the cup to produce a thin walled container body. The thickness of the bottom wall of the container remains unaltered to provide desired structural requirements which are greater in the container bottom wall area than in the sidewall for containers filled with pressurized contents, such as beer and carbonated beverages. After forming the container sidewalls the bottom wall is usually formed to a domed configuration to further increase its pressure resistance capabilities. Thus by forming the container body with thinner ironned sidewalls the container body can meet desired structural requirements yet be formed utilizing less metal stock material than if such container body did not have reduced thickness sidewalls.

Since all body makers produce container bodies having some inconsistency in the length of the sidewall the ironed container body sidewall is then trimmed to a predetermined constant length and thereafter the open end is necked in and provided with a flange for seaming thereto a closure end to seal the container after filling. For greater detail regarding the production of seamless metal containers, reference is made to an article appearing in the November, 1973 issue of Aerosol Age Magazine, entitled "The Drawn and Ironned Can—Understanding the Technology."

In order to reduce production cost of the container bodies attention has been given to increasing the production speed of the bodymaker ram and also to reducing the amount of starting metal stock material required for forming the container body. One typical early metal two piece can bodymaker to which this invention relates includes a horizontally recipprocating ram which at the forward end is movably supported and aligned in its stroke by a stationary forward hydrostatic oil bearing sleeve circumferentially surrounding the ram and secured to the body maker. The other, or rearward, end the ram is supported by an hydrostatic oil bearing slide block assembly which includes means for connecting the ram to the body maker drive mechanism. The slide block assembly constantly moves backward and forward with the rearward end of the ram during its stroke providing support and aligment therefore.

One limitation on the ram speed capabilities of much prior art body makers is that the hydrostatic oil bearing slide block assembly must be relatively massive, typically weighing approximately 240 lbs, to provide the desired support and alignment of the rearward end of the ram during its stroke. With this mass reciprocating at over 200 times per minute and with the distance between the two supporting points constantly changing, and with the tremendous forces generated in the high speed redrawing and ironing of the container body, it can be appreciated that the support and alignment of the container body maker ram is a complex problem.

One proposed design for increasing the speed of the recipprocating ram for a given power output and hence container production, is shown in U.S. Pat. No. 4,173,198. That reference disclosed supporting the ram with two stationary axially spaced hydrostatic oil bearing sleeves rather than the single oil bearing sleeve utilized in the earlier prior art body maker discussed above, however it teaches that the purpose of utilizing the two stationary oil bearing sleeves to align the ram is to allow the connection between the slide block and the rear end of the ram to be of a flexible nature so that the ram is isolated from the slideblock regarding non-axial movement. Thus the drive mechanism is only required to transmit forward and rearward motion to the ram, and not be relagated to a function of critically alignment of the ram since an alignment function would act to reduce the axial rearward and forward power transmitted to the ram thereby reducing ram speed.

In addition to providing flexibility in the connection, between the ram and slide block assembly, U.S. Pat. No. 4,173,138 also teaches that the slide block assembly itself can be provided with lateral flexibility or play relative to the slideway within which the slide block assembly is mounted. Utilization of such an arrangement is said to further isolate the rear end of the ram from an alignment function ensuring that the forces of the drive mechanism are only utilized to transmit forward and rearward movement.

In practice we have discovered the flexible or loose connection between the rearward end of the ram and slide block assembly cannot provide critical alignment and hence misalignment of the ram occurs. Loss of critical alignment is undersireable since it manifests itself by the production of out of spec container bodies having overly inconsistent sidewall length and thickness.

To a certain extent all body makers produce container bodies having portions of the sidewall which are of a greater or lesser length from the bottom wall to the open end than other regions of the sidewall and thus, as discussed above, it is required that the container bodies be trimmed in a separate operation to a constant standard length. The trimmed container bodies allow standardization of their length and volume and provide an edge at their open end which can readily be adapted for receiving a closure end. The amount of metal trimmed from the container body however represents metal scrap, and therefor it can be appreciated that the more consistently uniform the length of the sidewall is, the less mental need be used and less scrap need be produced. Thus it is desirable that consistent side wall length, occur during container body formation, such undersirable inconsistency in sidewall length is commonly referred to as "earing" or "sugar scooping." The term "earing" represents container bodies having localized sidewall regions of greater length than adjacent regions wherein the longer sidewall regions appear as somewhat ear-like shaped pieces of metal extending about the open edge of the sidewall. "Sugar Scooping" refers to container bodies wherein one side of the container body is of a noticeable longer length then the other side, somewhat akin to the shape of a sugar scooper. Container bodies formed with excessive earing and sugar scooping also presents problems in the flanging of the container bodies. This is because such containers have non-uniform sidewall thicknesses in the region adjacent to the open end of the container and thus during the operation of forming the flange on the container body a splitting of the sidewall at the flange is much more likely to occur. Earing and sugar scooping, as well as less severe inconsistences in the length of the container sidewall, most often are the result of ram misalignment relative to the bodymaker die assembly.

U.S. Pat. No. 4,173,138 teaches that the flexibility and play in the ram to slide block assembly connection has its greatest effect on misalignment when the ram is at the end of the rearward stroke since at this time the distance between rear end of the ram and the aligning stationary oil bearing sleeves is greatest. According to the reference the need for critical alignment is not great at this time since the ram is not in a functioning part of its stroke relative to the die assembly. However in practice it has been found that ram alignment is indeed critical prior to the rams entrance into operative relationship with the die assembly. This is because if the rear end of the ram is allowed to "fishtail" causing the front end of the ram to enter the die assembly in a misaligned manner, container bodies of overly inconsistent length and thickness can be produced. More specifically, where the first die of the die assembly is a redraw die the initial misalignment reforms the cup into a cup having sidewalls with a nonsymetrical metal distribution which can eventually result in ironning to inconsistent container body sidewall lengths and thicknesses, even if the remainder of the ram stroke is aligned relative to the ironing dies. As mentioned previously some body maker die assemblies do not include a redraw die. In such case the failure to provide critical alignment of the rear end of the ram as it initiates its stroke causes an inconsistent sidewall length since misalignment of the ram results in inconsistent ironing of the sidewall forming certain regions of the sidewall to a of greater or lesser length and thickness than other regions. Of course it is understood that any misalignment of the ram which continues past the initial die of the die assembly further compounds the problem of attempting to produce containers of relative consistent length.

In order to reduce container production costs to provide an advantage, manufacturers are continually arriving to reduce the amount of metal utilized in forming a container body. Most conmmonly this is accomplished by maintaning the standard diameter of the disc blank stock but reducing its thickness to for example 0.0145 inch thick H-19 temper aluminum stock. When using such thinner metal, ram alignment becomes even more critical since the container body is ironed to a length which is closer to the trim length than in the case where a thicker gauge stock is used and the container body is formed having a side wall more in excess of the trim length. Thus in utilizing the thinner gauge metal it is more likely that ram misalignment causing earing or sugar scooping will result in a sidewall which fails in all regions to meet the minimum trim length. Moreover with the thinner guage stock, inconsistent ironning resulting from ram misalignment is also more likely to result in sidewalls which do not meet minimum thickness requirements.

We have also found that the failure to provide critical alignment of the rear end of the ram as taught by the referenced patent makes it less suitable for forming container bodies from the thinner guage stock material where ram alignment is expecially critical. Moreover the play provided by the flexible nature of the connection between the ram and slide block assembly allows more drift in the rear end of the ram. Such drift allows a leveraging of the tremendous forces generated during ironing and over a period of operating time has a tendency to cause serious misalignment of the ram. To correct such misalignment production must be halted, typically 6 to 8 hours, and valuable production time is lost during such shut down.

SUMMARY OF THE INVENTION

According to present invention the disadvantages of the prior art are overcome by providing a method and appartus for producing metal drawn and ironed container bodies wherein the ram is supported and maintained critically aligned at its rearward end and at least two other points forwardly thereof to thereby provide high speed production of container bodies of acceptably consistent length over a longer period of operation. Preferable the two forwardly located ram support and alignment points are provided by pair of hydrostatic oil bearing sleeves fixedly mounted to the bodymaker and through which the ram is axialy and slideably mounted. Rearward ram support and alignment is preferable provided by a relatively lightweight ram block slide assembly slideable within a slideway secured to the body maker.

The ram block assembly includes a plurality of hydrostatic oil bearings restraining movement of the ram block assembly in all directions other than axially forward and rearward along the path of the ram stroke. The rearward end of the ram block assembly is connected to the bodymaker drive mechanism for supplying forward and rearward ram movement, while the front end of the ram block is rigidly connected to the rear end of the ram. Such rigid ram to ram block connection is preferably made and maintained by utilization of a ram having a generally cylinderical body and an integrally formed outwardly extending flange on the rear end thereof rigidly secured to the front end of the ram block, such as by a plurality of circumferentially spaced bolts extending through the ram flange into the ram block assembly, The outwardly flanged rear end of the ram provides an increased contact area for distributing the rearward forces of the ram reducing the occurance of wear of the surface to which it is mounted to so that the rigid connection may be maintained for a longer period of operating time. Moreover, the simple and direct method of mounting the ram to the ram block, rather than using less direct methods of mounting such as a collar and retaining ring arrangement more subject to wear, also maintains the rigid connection for longer periods of operation.

By supporting and critically aligning the ram by at least two forwardly located stationary points and also by the slide ram block rigidly connected to the rear end of the ram, the ram is critically aligned and maintained in critical alignment for long periods of operating time. Thus with the present invention it is possible, for example, to produce commercially acceptable consistent length container bodies for 12 oz. beer beverage cans from a disc of 0.013 inch thick or less H-19 temper aluminum stock having a diameter of of 5.960 inches at a rate of 200 to 250 containers per minute while significantly reducing the amount of bodymaker down time required for correcting ram misalignment.

BRIEF DESCRIPTION OF THE DRAWINGS

The invention will be more clearly understood by reference to the following detailed description of an exemplary embodiment thereof in conjunction with the drawings in which:

FIG. 7 is a partial fragmentary sectional side view of the ram block assembly, ram and secondary connecting rod showing a portion of the oil and air passageways in the ram block;

FIG. 8 is a side plan view of the ram block assembly showing the vertical side oil bearing pad;

FIG. 9 is side sectional view of the vertical side oil bearing pad; and

FIG. 10 is a fragmentary, side sectional view of the ram and ram block.

DETAILED DESCRIPTION

Figure 1:
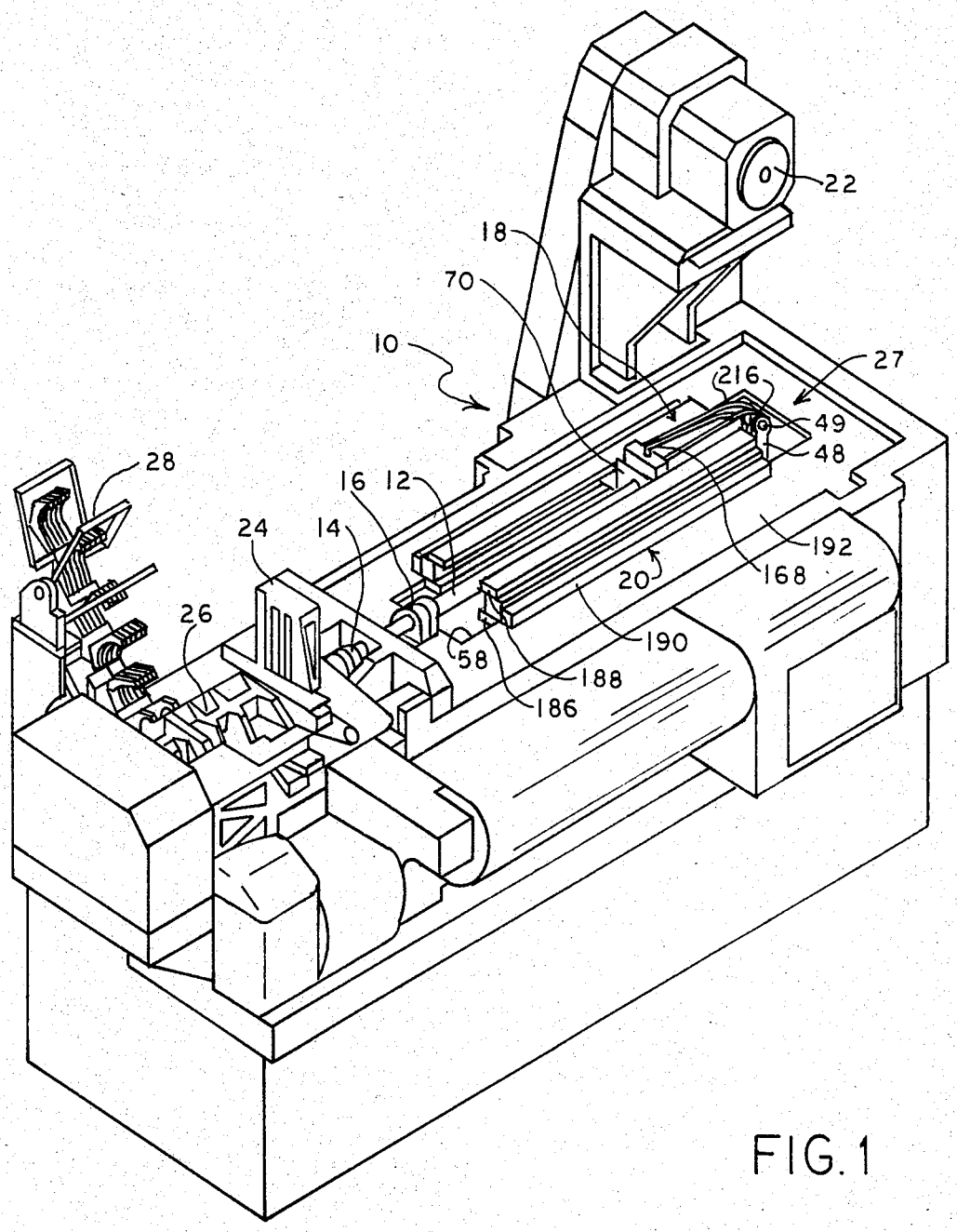
FIG. 1 is a perspective view of a typical bodymaker machine incorporating the ram and ram block assembly of the present invention.

Referring to FIG. 1 it is indicated at 10 a typical body maker machine of the type to which the improved ram design and ram block slide assembly and principles of the present invention are adaptable. Briefly, in operation body maker 10 receives previously formed shallow metal cups and reforms such cups into relatively deep seamless containers by individually forcing said cups through a series of dies as discussed previously and is well known in the container industry. The body maker disclosed in FIG. 1 is for purposes of illustrating a typical environment for the improvement ram and ram block slide assembly of the present invention and it is not intended that application of the improvements be limited to the specific body maker shown as such improvements and the priciples of the present invention are adaptable to a number of various body maker designs.

To provide a brief and general overview, it is shown in FIG. 1 that body maker 10 includes a reciprocating ram 12 supported and critically aligned by a pair of stationary oil bearing sleeves or guides 14 and 16 secured to the frame of body maker 10. The rearward end of ram 12 is rigidly secured to a ramblock or slide block assembly indicated generally at 18 which supports and critically aligns the rearward end of ram 12 during its forward and rearward stroke. Ram block assembly 18 is slideably mounted within slideway assembly 20 secured to body maker 10 in a parallel relationship to the central axis the ram stroke path. As described below in greater detail ram block assembly 18 is provided with a plurality of hydrostatic oil bearings to restrain movement of ram block assembly 18 within slideway 20 in all directions except axialy forward and rearward. Body maker 10 also includes a suitable power means such as an electrical motor 22 which is operably connected by suitible drive means 27 to the rear end of ram block assembly 18 as described later in much greater detail to provide forward and reward movement thereto. Body maker 12 also includes a cup in-feed, such as chute 24, for individually feeding cups to a position where they are engaged by and over the forward end of ram 12 on its forward stroke to subsequently be forced into a tooling or die assembly 26 to produce elongated ironed container bodies. Body maker 10 further includes a container body outfeed means 28 transfer the formed container bodies from the body maker apparatus.

Thus by means of the present invention wherein a rigid connection is provided between ram 12 and ram block assembly 18 and by restraining non axial movement of ram block assembly 18, critical accurate alignment of the rear end of ram 12 can be established to aid in the production of container bodies having less inconsistencies in sidewall length. Moreover by providing support and critical alignment for the rearward ram end the tendency for the ram to drift out of alignment over a period of operating time is substantially reduced thereby reducing the frequency of production shutdowns for manual adjustment of ram alignment. In addition the rigid connection at the rear end of ram 12 reduces ram vibration from that experienced during body maker operation with the prior art flexible connection of the ram. This has the effect of reducing punch abuse and increasing tool life.

Figure 2:
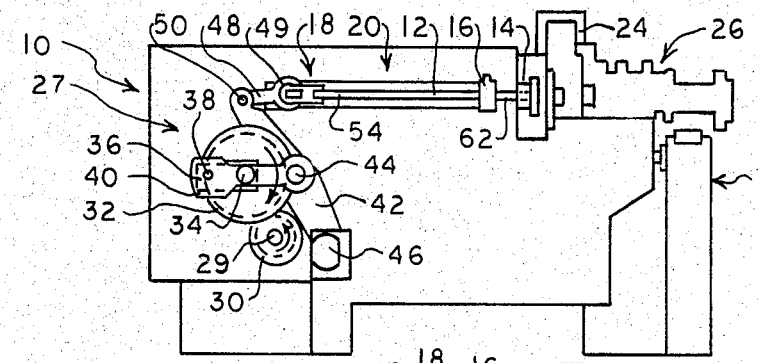
FIG. 2 is a somewhat diagramatic side view of the bodymaker showing the drive mechanism and the position of the ram at the most rearward part of its stroke.

To provide greater detail of the operation of the bodymaker the diagrammatic view of the bodymaker 10 in FIG. 2 shows drive mechanism indicated generally at 27 which translates the rotative forces of the electric motor 22 (shown only in FIG. 1) into a horizontally recipprocating motion of ram 12. Drive mechanism 27 includes a main drive shaft 29 which is connected at one end to electric motor 22 through a drive belt and at the other end to a pair of drive gears 30. (only one of which is shown schematically.) Gears 30 engage another pair of gears 32 (only one of which is shown schematically) mounted on a rotatable shaft 34. A crank arm 36 is secured to each of the facing sides of gears 32 with the outer ends of crank arms 36 supporting a crank pin 38. A primary connecting rod 40 is rotatably secured at one end to pin 38 and rotatably secured at the other end to an intermediate point of a swing lever 42 by a second crank pin 44. Swing lever 42 is pivotably support to the body maker at its lower end 46 and at the other end is pivotally secured to a secondary connecting rod 48 by pin 50. As described later in greater detail the opposite end 49 of secondary connecting rod 48 is pivotally secured to slidable hydrostatic oil bearing ram block assembly 18. Slideable ram block assembly 18 is rigidly secured to the rearward end 54 of ram 12 with ram block assembly 18 slidably mounted within slide way assembly 20 which, as shown in FIG. 1 may be secured along the top, bottom, and side walls of a horizontally extending channel 58 provided in the body of bodymaker 10.

It is again seen in FIG. 2 that ram 12 is slideably mounted through axialy spaced rear end forward hydrostatic oil bearing slide sleeves 14 and 16 respectively. Sleeves 14 and 16, may be of a construction as known in the art wherein such sleeves have a generally cylinderical bore through which ram 12 is slideable recieved and have a plurality of circumferentialy spaced oil bear pads directing a flow of pressurized oil against the outer cylinder surface of ram 12 to provide support and alignment of the ram without metal to metal contact with the ram.

Ram 12 is shown in FIG. 2 in its most rearward position as ram 12 is about to start its forward stroke. In such position the forward portion of the ram is supported and critically aligned by sleeves 14 and 16, as with certain prior art bodymakers, and in accordance with the present invention the rearward end of Ram 12 is rigidly secured to ram block assembly 18 for support and critical alignment of the rearward end of ram 12. From the most rearward position of ram 12 shown in FIG. 2, ram 12 is moved forwardly by the electric motor's rotation of gears 22 to cause the forward extension of primary connecting rod 40, swing lever 42 and secondary connecting rod 48. The forward movement of rod 48 forces ram block assembly 18 to slide forwardly within slide way 20 punching ram 12 in a forward direction. The forward or punch end 62 of ram 12 engages cup from a cup feeding mechanism 24 during its forward movement and subsequently forces the cup through die assembly 26 to form an elongated ironed container body as previously described.

Figure 3:
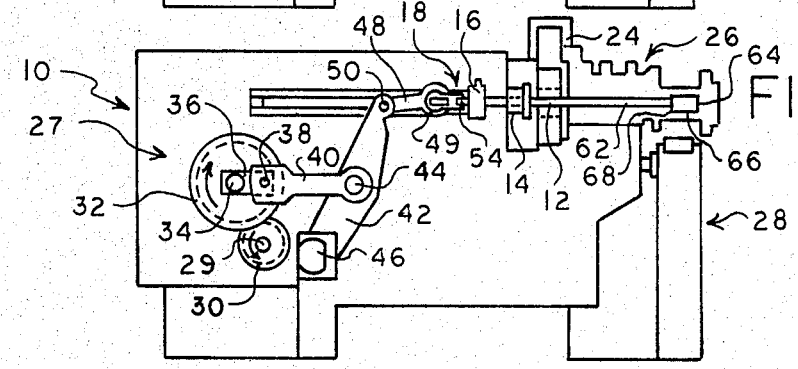
FIG. 3 is a somewhat diagramatic sideview of the body maker showing the drive mechanism and the position of the ram at the most forward part of its stroke.

In FIG. 3 ram 12 is shown in the most forward position of its stroke with a drawn and ironned container body 64 formed over punch end 62 of ram 12. At this point container body 64 is stripped from punch end 62 by suitable means such as a typical mechanical stripper. The mechanical stripper (not shown because it is well know in the art) grips the circumferential edge 66 of the open end of the container body sidewall 68 holding it in a stationary position as ram 12 is withdrawn from container body 64 as it begins its rearward stroke returning to the initial position shown in FIG. 2. Stripping may be also be accomplished or aided by the air pressure directed through an opening in punch end 62 of ram 12 against the inner surface of the bottom wall of container body 64. The stripped container body 64 drops downwardly to outfeed means 28 and is subsequently transferred to machinery for trimming the container body to a constant length and then the container body side wall is necked-in and flanged so as to provide a contained body which is adaptable, after filling with contents, to allow the attachment of a container end closure thereto.

Figure 4:
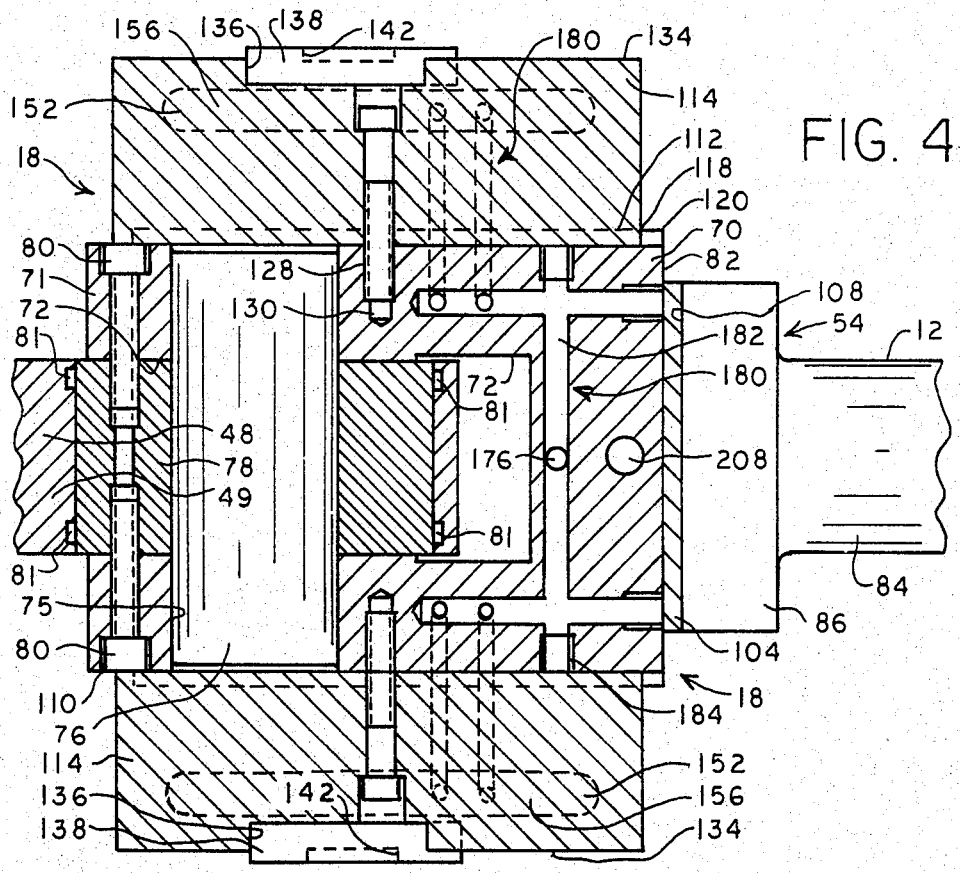
FIG. 4 is a fragmentary, top sectional view of the ram block assembly operably connected to the secondary drive rod at the rear end, and at the front end having the rear end of the ram rigidly secured thereto.

In FIGS. 4–8 the ram block assembly means 18 for supporting and aligning rearward end 54 of punch 12 in accordance with the principle of the present invention is shown in greater detail. Ram block assembly 18 includes a ram block 70 having a yoke like shaped rear end portion 71, as best seen in FIG. 4, providing an opening 72 within which is mounted secondary connecting rod 48 for transmitting forward and rearward movement to ram block 70. For the purpose of mounting and pivotally securing front end 49 of connecting rod 48 to ram block 70, the ram block 70 includes a lateral bore 75 therethrough within which is inserted a pin 76 for mounting a cylinderical race 78 thereover. Race 78 may be further secured to ram block 70 by bolts 80. Secondary connecting rod 48 is counted for pivotal movement about race 78 and is provided with a plurality of hydrostatic oil bearings 81 to supply pressurized oil to prevent metal to metal contact between secondary rod 38 and race 78.

Ram block 70 also includes a generally flat front face portion 82 for rigidly securing ram thereto. As best seen in FIG. 10 ram 12 includes a cylinderical body 84 terminating at its rear end in an integrally formed mounting flange 86. Forward of ram body 84 is a cylinderical integrally formed punch mounting portion 88 of reduced diameter for the axial mounting of a punch 90. The outer punch surface 92 extends a small distance beyond the outer surface 94 of ram body 84 so that if a ring shaped "tear off" of the container body occurs access is provided for cutting such tear off and more quickly removing it from the ram body 84. Also it is noted that the rearward end 91 of ram punch 90 has a slightly smaller diameter, for example approximately 0.0025 inch (shown in an exagerated manner in FIG. 10), than that of the forward remainder 93 of punch 90. This allows a reduced ironing of the container body sidewall region adjacent the open end of the container body providing a thicker sidewall for the container body in the region which is to be flanged in a subsequent flanging operation. Rearward movement of punch 90 relative to ram 12 is restained by a shoulder 97 in ram 12 and adjacent thereto may be included a spacer or wear ring 96. A mounting nut 98 secures punch 90 to ram 12 at the forward end there of.

Of particular importance to practicing the present invention is the rigid connection between ram 12 and ram block 70. Preferably to accomplish such rigid connection ram flange 86 is provided with a plurality of axial spaced bolt holes 100 for alignment with a like number of axial spaced threaded holes 102 in forward face 82 of ram block 70. A plurality bolts 106 are utilized to rigidly secure ram 12 to forward face 82. It is noted that the rearward face 108 of flanged end 86 outwardly extends from ram body 84 to provide an enlarged contact area with wear plate 104. This allows the rearwardly directed forces on the ram generated during container body formation to be distributed a greater area to increase the period of operating time before wear reduces the rigidity the ram connection necessitating a tightening of bolts 106, or replacement or wear plate 104. Furthermore it is noted that a direct connection of the ram 12 to wear plate 104 and ram block 70 by bolting is made possible by ram flange 86 of the present invention. This offers on advantage over certain other prior art methods of ram attachment utilizing retaining rings, collars, and the like, since such rings and collars are subject to wear thereby reducing the possiblity of maintaing a rigid connection, and critical alignment of the ram.

Also for the purpose of providing and maintaining critical axial alignment of the rear end of ram 12, the ram block assembly 18 is provided with means to maintain critical alignment as is moves rearwardly and forwardly in slideway assembly 20. The vertical interal sides 110 of ram block 70 each have a channel 112 within which is mounted a generally block shaped oil bearing hydrostatic pad 114, as best seen in FIGS. 4 an 5. Refering to Fig. 4, proper registration of hydrostatic pad 114 is keyed by a shoulder 118 formed in ram block 70 at the forward terminus 120 of channel 112. Hydrostatic pads 114 are fully secured to ram block 70 by bolts 128 threadedly secured within holes 130 appearing is vertical sidewalls 110 of ram block 70. The outer vertical side 134 of each hydrostatic pad 114 have a bore 136 within which is inserted a generally cylindrical vertical oil bearing pad insert 138 which may extend outwardly a small distance beyond the surface of face 134 of hydrostatic pad 114. Vertical pad inserts 138 are secured in place by suitable means such as bolting to hydrostatic pads 114. As best seen in FIG. 9, vertical oil bearing pads 138 have an oil outlet 142 on its outermost side and an oil passageway 144 to its inner surface with a counter bore 146 providing a recess for mounting an "O"-ring therein.

Figure 5:
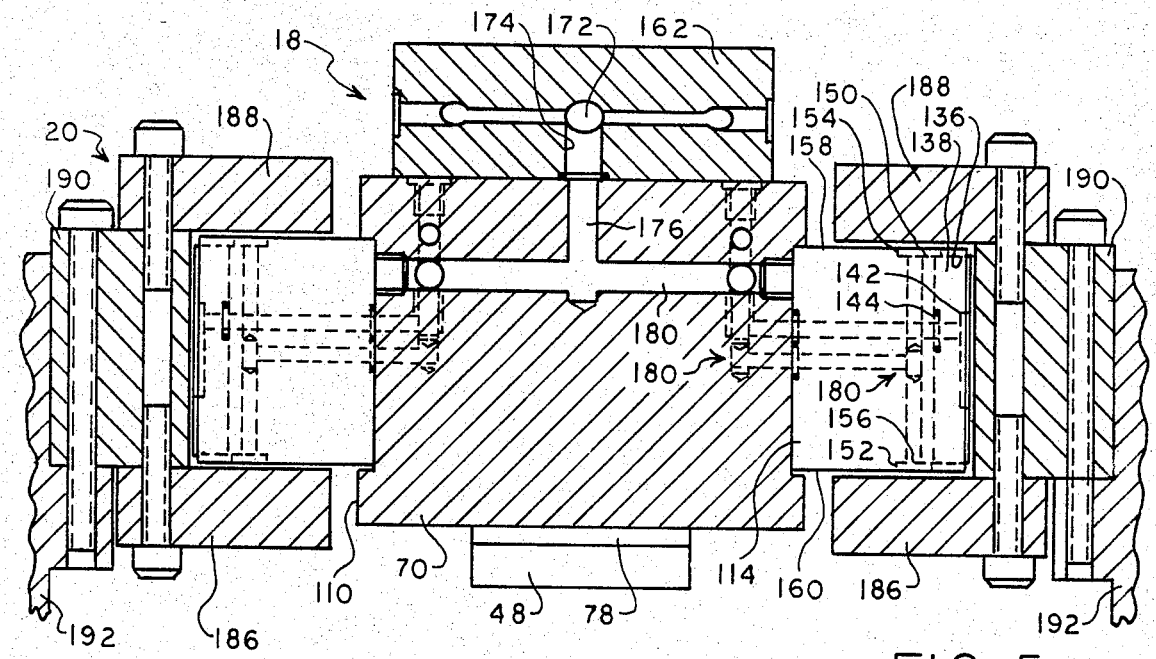
FIG. 5 is a front sectional view of the ram block assembly mounted within the slideway assembly and showing a portion of the oil passageways within the ram block and hydrostatic pads.
Figure 6:
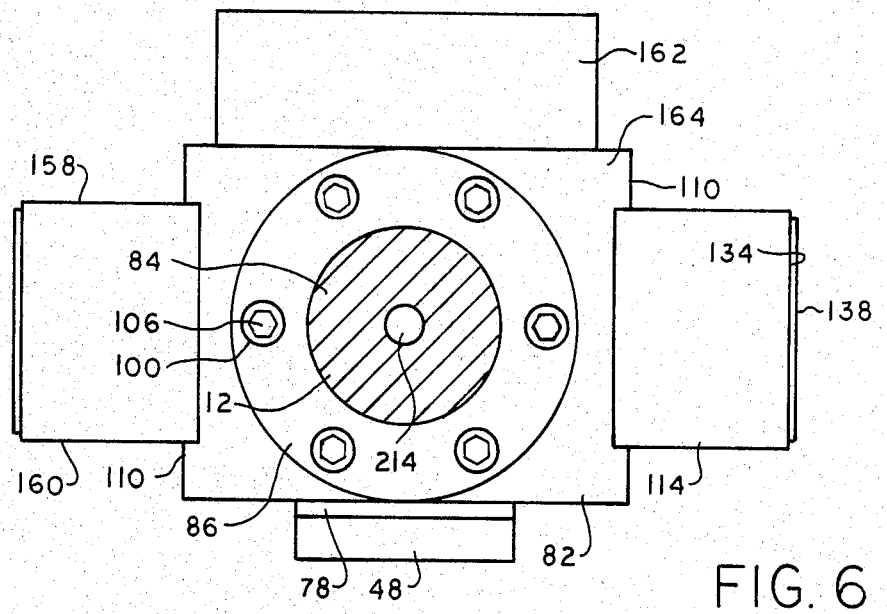
FIG. 6 is partial front sectional view of the ram block assembly and ram mounted to the front side of the ram block.

Refering to FIG. 5 each of hydrostatic pads 114 also have a top bearing pad 150 and a lower bearing pad 152 which may be in the form or elongated grooves 154 and 156 respectively appearing in the outer surfaces top and lower sides 158 and 160 of hydrostatic pads 114. The top, bottom, and vertical side oil bearing pads are connected as described below to a source of pressurize oil or other liquid lubrication (not shown) which directs a stream of pressurized oil against the adjacent sides of slideway assembly 20 during the ram stroke to restrain movement of the ram block in all directions except axially along the slideway.

For connecting the pressurized oil source to ram block assembly 18 a manifold 162 is attached to the top 164 of ram block 70. The connection between the pressurize oil source and manifold 162 is preferably by means of a flexible tubing 168 which follows the movement of ram block assembly 18 as it moves back and forth within slide way assembly 20 during the operating stroke of ram 12.

As best seen in FIG. 7 manifold 162 has a bore 72 to which the flexible tube 168 is connected in suitable fashion such as by connector 170. A verticle bore 174 provides an oil passageway out the bottom of manifold 162 into an aligned vertical oil passageway 176 in ram block 70. A plurality of bores 180 appearing in ram block 70 and hydrostatic pads 114 provide oil passageways to top, bottom and side oil bearing pads 150, 152 and 142 respectively.

Thus as most clearly illustrate in FIG. 5, each hydrostatic pad 114 of the ram block assembly 18 is slideable mounted within the slideway assembly 20 comprised of a bottom slideaway 186, a top slideaway 188 and a side slideway 190 secured to the frame 192 of body maker 10. A clearance of approximately 0.005 inches is provided between pad 114 and slideway 20. By providing a suitable oil flow at a pressure of approximately 110 P.S.I. from top 150, bottom 152, and side 142 bearing pads against the surface of top 188, bottom 186, and side 190 slideways the ram block 70 and rigidly secured ram rear end 54 can be provided with and maintained in critical alignment relative to die assembly 26.

As discussed previously, to accomplish or aid in the stripping of a container body 64 from the punch end 62 of ram 12 a jet of pressurize air may be provided through the ram and directed at the inner bottom surface of the container end wall. To accomplish such proceedure, as best seen in FIG. 7, manifold 162 is provided with an air passageway 198 having a top opening 200 connected to a pressurized air source (no shown because it is well known in the art) by a flexible hose 202 andp opening 200 connected to a pressurized air source (no shown because it is well known in the art) by a flexible hose 202 and suitable connection means such as connector 204 attached about manifold opening 200. Manifold air passageway 198 is aligned with an air passageway 208 in ram block 70. A bore 212 in wear plate 104 is aligned with passaway 208 to allow the passage of pressurized air into an axially centered bore 214 in ram 12. As best seen in FIG. 10 bore 214 extends from flanged end 86 of ram 12 to punch end 62 of ram 12. The body maker is provided with suitiable air control means (not shown) to monentarily open a normally closed air valve (not shown) at the appropriate time at the end of the ram's stroke forming a container body to direct a jet of air pressure out the punch end of the ram against the container body end wall to thereby urge the container off the punch 90 on ram 12.

Suitable and preferrable for practicing the present invention is a ram 12 having a length of approximately 50 inches with an outer flange 86 diameter of approximately 4.5 inches. To provide increased rigidity of the ram the outside diameter ram body 84 preferably is approximately 2.5 inches and preferrably has a close tolorence such as +0.0000 inch and −0.0004 inches. This represents an increase of approximately ⅛ inch in the outside diameter or prior art rams for bodymakers such as that disclosed in U.S. Pat. No. 4,173,138. The diameter of bore 214 preferably is approximately 1.25 inches from adjacent flange end 108 to adjacent the junction between ram body 84 and punch mounting portion 88. A reduction of the diameter of bore 214 to preferrably approximately 0.7 inches extends forwardly towards the punch end of ram 12 to provide increased rigidity and support in the punch end of ram 12.

It is also noted that an oil passageway can be provided from manifold 162 to supply oil to the hydrostatic bearing 81 of secondary connecting rod 48. As shown in FIG. 1 flexible hoses 216 are suitible for providing such connection. It is also understood that the bodymaker may be provided with a sump pump (not shown) to recirculate the oil for the oil bearing referred to herein.

By supporting and aligning the ram with two or more axially spaced stationary hydrostatic oil sleeves the ram block assembly can be of a relatively lightweight, for example 45–50 pounds. Moreover it has been found that by even when the rearward end of the ram is rigidly secured to the ram block assembly and no lateral play is allowed between the ram block assembly and slideway, high speeds of commercial countainer body production such as 200 to 250 cans per minute are still possible utilizing conventional motor means. Furthermore since the rear end of the ram is critically aligned by the rigid connection and the ram block assembly being restrained in all directions except axially, the ram is not allowed to fishtail at the rearward part of its stroke, but instead is maintained at all times in critical axial alignment relative to the die assembly. Thus by preventing misalignment of the ram, container bodies of more consistent sidewall length can be produced at high speeds, and advantage of this can be make in utilization of thinner guage metal stock to form the container bodies at a significant reduction in cost. For example by utilizing the principles of the present invention commercially acceptable 12 oz. standard beer or beverage containers can be formed at a rate of 250 per minute from cups made from a disc of 0.013 inch thick or less H-19 aluminum stock having a diameter of 5.96 inches. By maintaining critical alignment of the rear end of the ram container bodies can be produced at such high rates of speeds with a side wall thickness of approximately 0.005 inch ± 0.0001 inch in the thin walled region of the sidewall and a thickness of approximately 0.0072 inch ± 0.0003 inch in the region of the side wall which is to be subsequently provided with a flange.

Moreover in a bodymaker utilizing the improvements of the present invention it has been determined that the ram is less likely to drift out of alignment to the extent that a shutdown of production is required to realign the ram. More specifically it has been found that with the improvements of the present invention a bodymaker can operate without requiring shutdown for realignment generally twice as long as the same bodymaker utilizing the prior art flexible ram connection means and a ram block assembly wherein interal play of the ram block within the slideway is permitted. Thus valuable production time as well as maintainence costs are saved.

Although the teachings of the invention have been discussed with reference to certain specific disclosured embodiments, it is to be understood that these are by way of illustration only and that others may wish to utilize the invention in different designs and/or applications.

What is claimed is:

1. A container body maker for reforming cup means into elongated container body means, said bodymaker having a frame means including a slideway means, an axially extending ram means movable along said slideway means, said ram means having a forward end and a rearward end and being movable in operation between a forward position and a rearward position, at least two guide means connected with said frame means for supporting and aligning said ram means, drive means for moving said ram means reciprocally and axially along said slideway between said forward and reaward positions, tooling means associated with said frame means forward of said guide means and in an operable relationship to and in axial alignment with said ram means, said forward end of said ram means being a predetermined space from said tooling means when said ram means is at its rearward positon, an infeed means for feeding said cup means into said predetermined space between said tooling means and said forward end of said ram means whereby said cup means will be pushed by said forward end of said ram means during said forward stroke of said ram means, said ram means being adapted to force said cup means into and through said tooling means to reform said cup means into an elongated container body means, means for removing said container body from said ram; a liquid bearing slide block assembly means having a first portion and a second portion, said first portion portion being rigidly connected to said rearward end of said ram means, said slide block assembly means being axially movable along said slideway means and being restrained against lateral movement relative to said slideway means in all directions other than in the direction of axial movement whereby lateral movement of said slide block assembly means is minimized and movement of said slide block assembly means is effectively confined to axial movement along said slideway means, said combination of said guide means, slide block assembly means and said rigid connection of said ram thereto providing stable support and accurate alignment of said ram means with said tooling means.

2. The bodymaker as claimed in claim 1 wherein said stationary supporting means are axially spaced hydrostatic oil bearing sleeves circumferentally surrounding said ram and allowing said ram to slide therethrough.

3. The bodymaker as claimed in claim 1 wherein said slide block assembly means is relatively lightweight and reciprocates at over 200 strokes per minute.

4. The bodymaker as claimed in claim 1 wherein said slide block assembly means includes hydrostatic oil bearing pads on the top, bottom and opposite sides thereof for restraining said lateral movement.

5. The container bodymaker as claimed in claim 1, wherein said ram means includes an integrally formed flange means extending outwardly from said rearward and thereof, said flange means being fixedly secured to said second portion of said block assembly means to provide a rigid connection therebetween.

6. The bodymaker as claimed in claim 1 wherein said tooling means includes at least one ironing die accurately spaced from the adjacent surface of said ram means whereby the sidewall of said cup means being forced therebetween is relatively uniformly reduced in thickness and relatively uniformly elongated as it is forced therebetween.

7. A ram and ram slide block assembly means adaptable to slide in the slideway means of a bodymaker for making seamless container bodies from a cup means, said slide block assembly means including a block means having a front end, a rear end, generally opposed top and bottom sides and generally opposed lateral sides, said block means having a hydrostatic oil bearing pad means on each of said lateral sides and extending outwardly therefrom, each of said hydrostatic pad means having a top surface, a bottom surface and an outer side surface, each of said surfaces of said hydrostatic pad means having an oil outlet therein for directing a stream of pressurized oil outwardly from said surface adapted to form a hydrostatic oil bearing with surfaces of said slideway adjacent to said hydrostatic pad means when said ram block assembly is mounted in said bodymaker, said ram including a generally cylindrical body having a front end for use in forming thereon said seamless containers and a flanged rear mounting end said mounting end being rigidly secured to said front end of said block means and extending forwardly therefrom and said ram block assembly being adapted to be moved at high speed along said slideway means.

8. A ram and slide block assembly means as claimed in claim 7 wherein said top and bottom sides of said block means include hydrostatic oil bearing pad means thereon for cooperating with said adjacent slideway means to restrain lateral movement of said slideblock assembly within said slideway.

* * * * *